US007661968B1

(12) United States Patent
Duan et al.

(10) Patent No.: US 7,661,968 B1
(45) Date of Patent: Feb. 16, 2010

(54) ELECTRICAL CONNECTOR

(75) Inventors: Li-yang Duan, Tu-Cheng (TW); Wei-hong Liao, Tu-Cheng (TW); Ming-chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,645

(22) Filed: Nov. 24, 2008

(51) Int. Cl.
*H01R 13/44* (2006.01)

(52) U.S. Cl. ..... 439/135; 439/862

(58) Field of Classification Search ..... 439/135, 439/660, 862, 940
See application file for complete search history.

(56) References Cited

U.S. PATENT DOCUMENTS 6,447,338 B1 * 9/2002 Bricaud et al. ..... 439/630
6,663,445 B1 * 12/2003 Yeh ..... 439/862
6,688,893 B1 * 2/2004 Huang et al. ..... 439/66
6,702,621 B2 * 3/2004 Yeh ..... 439/660
7,442,043 B2 * 10/2008 Yuan et al. ..... 439/56
7,510,411 B2 * 3/2009 Wu et al. ..... 439/135
2007/0218722 A1 * 9/2007 Chen et al. ..... 439/135
2007/0224890 A1 * 9/2007 Chien et al. ..... 439/862
2007/0249194 A1 * 10/2007 Liao ..... 439/135

* cited by examiner

*Primary Examiner*—Hien Vu
(74) *Attorney, Agent, or Firm*—Rosenberg, Klein & Lee

(57) ABSTRACT

An electrical connector has an insulating housing defining a top surface, a front surface and a rear surface opposite to the front surface. A plurality of terminals are mounted in the insulating housing, each has a contacting portion exceeding the top surface of the insulating housing. At least one of the contacting portions is adjacent to the rear surface. And a cover coupled with the insulating housing has a covering plate suspended over the top surface of the insulating housing. At least one anti-mismating portion corresponding to the terminal of which the contacting portion is adjacent to the rear surface, extends downwardly from the covering plate for being mounted on a portion of the top surface adjacent to the front surface. The anti-mismating portion is capable of interfering with the contacting portion of the terminal when the cover is mounted to the insulating housing in a contrary way.

10 Claims, 5 Drawing Sheets

ELECTRICAL CONNECTOR

BACKGROUND OF THE INVENTION

1. Field of the Invention

The present invention relates to an electrical connector, and more particularly to an electrical connector capable of preventing mismating assembly.

2. The Related Art

With the ever-increasing miniaturization and multifunction of electronic devices, it is necessary for an electrical connector mounted in the electronic device to reduce its volume for meeting the development demand. As a result, the electrical connector having a small volume becomes difficult to be assembled. Especially, some processes are easy to generate errors and take more assembling time, what's more, they may damage the electrical connector. Therefore, it is important to provide an electrical connector capable of preventing mismating assembly.

At present, there exists the electrical connector having a mark formed thereon for instructing the right operation. But, because the mark stamped on the appearance of the electrical connector with a small volume is hard to see, an operator is easy to make mistakes because of carelessness. So such mark is not quite secure and reliable to be used in the electrical connector to prevent mismating assembly.

SUMMARY OF THE INVENTION

Accordingly, an object of the present invention is to provide an electrical connector having a simple structure to prevent mismating assembly efficiently.

The electrical connector has an insulating housing defining a top surface, a front surface and a rear surface opposite to the front surface. A plurality of terminals is mounted in the insulating housing. Each of the terminals has a contacting portion exceeding the top surface of the insulating housing. At least one of the contacting portions of the terminals is adjacent to the rear surface. A cover coupled with the insulating housing has a covering plate suspended over the top surface of the insulating housing. At least one anti-mismating portion corresponding to the terminal of which the contacting portion is adjacent to the rear surface, extends downwardly from the covering plate for being mounted on a portion of the top surface adjacent to the front surface. The anti-mismating portion is capable of interfering with the contacting portion of the terminal when the cover is mounted to the insulating housing in a contrary way.

As described above, when the cover is reversely assembled to the insulating housing, the anti-mismating portion interferes with the contacting portion of the terminal so that the cover can not be mounted to the insulating housing, which is reliable to avoid the cover from coupling with the insulating housing in a contrary way.

BRIEF DESCRIPTION OF THE DRAWINGS

The present invention will be apparent to those skilled in the art by reading the following description when taken in conjunction with the accompanying drawings, in which.

DETAILED DESCRIPTION OF THE PREFERRED EMBODIMENT

Figure 1:
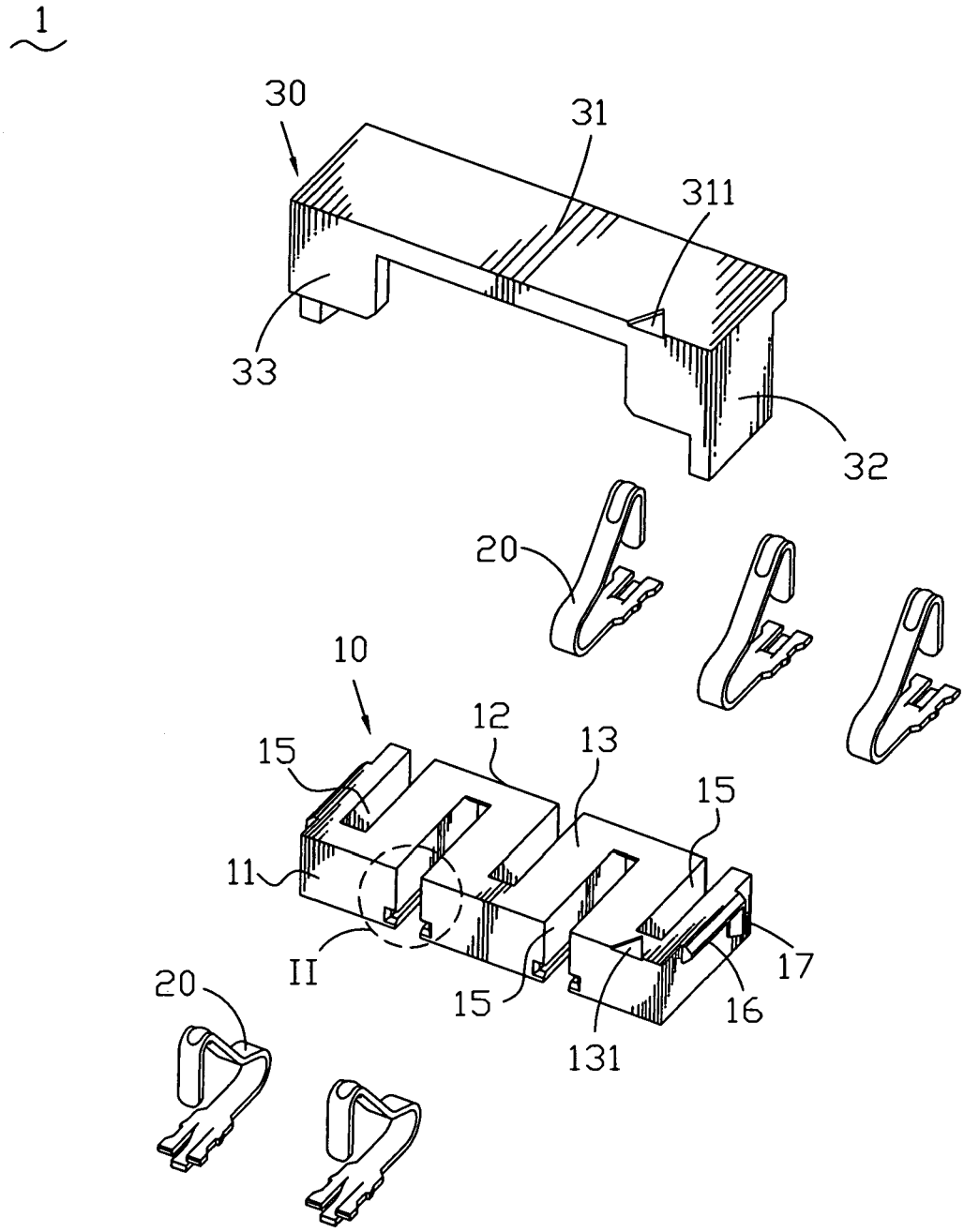
FIG. 1 is an exploded, perspective view of an electrical connector of an embodiment in accordance with the present invention.

With reference to FIG. 1, an embodiment of an electrical connector 1 according to the present invention is shown. The electrical connector 1 includes an insulating housing 10, a plurality of terminals 20 received in the insulating housing 10 and a cover 30 coupled with the insulating housing 10.

Figure 2:
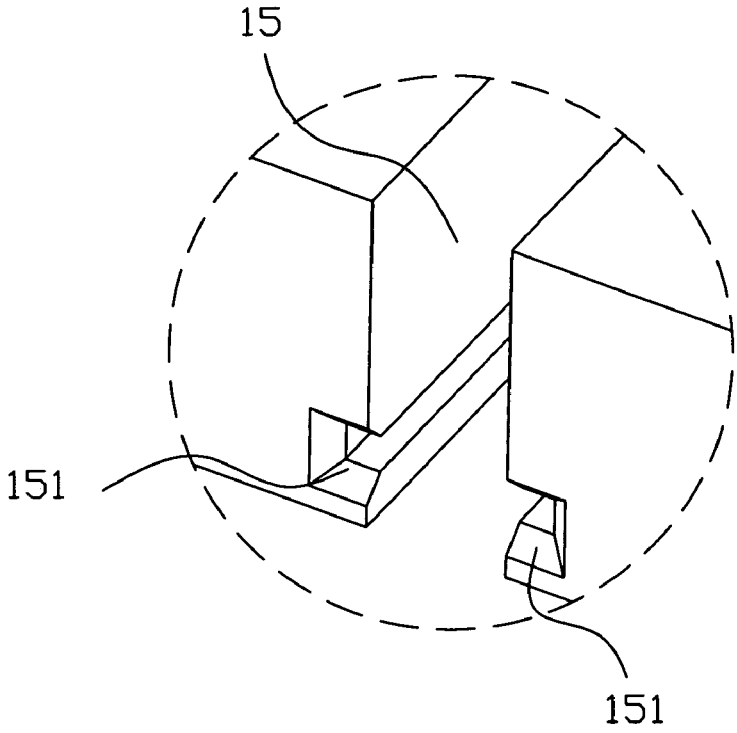
FIG. 2 is a partly enlarged view showing an enlarged II portion of the FIG. 1.
Figure 3:
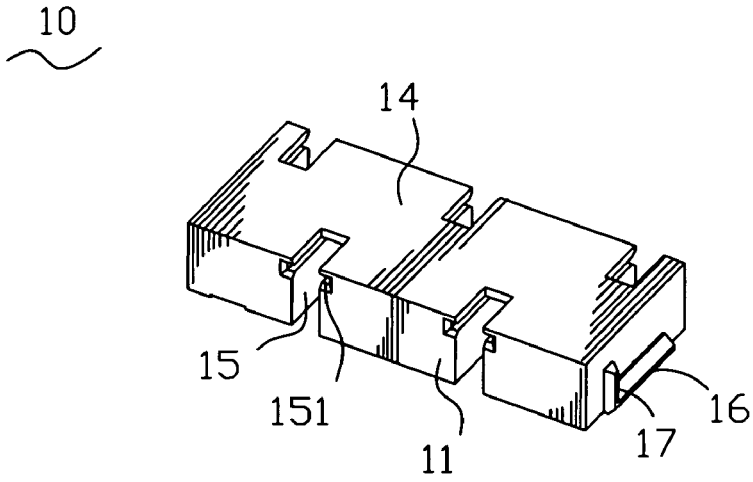
FIG. 3 is a perspective view of an insulating housing of the electrical connector shown in FIG. 1 seen from the bottom view.

Please refer to FIGS. 1-3, the insulating housing 10 is substantially rectangular and defines a front surface 11, a rear surface 12, a top surface 13 and a bottom surface 14. The top surface 13 has a first directing cavity 131 communicating with the front surface 11. The first directing cavity 131 is triangle shape, with an angle pointing at the rear surface 12. The insulating housing 10 has five grooves 15 extending frontward and rearward for receiving the terminals 20, two of which define openings at the front surface 11 and three of which define openings at the rear surface 12, arranged at intervals and extended to reach the top surface 13 and the bottom surface 14. The length of the groove 15 passing through the top surface 13 is longer than that of the groove 15 passing through the bottom surface 14. Two bottom sides of each of the groove 15 are respectively recessed to form a buckling recess 151. One side of the insulating housing 10 has a stopping portion 16. The stopping portion 16 extends frontward and rearward with a predetermined distance and has a top surface flush with the top surface 13. An end of the stopping portion 16 adjacent to the rear surface 12 extends downwardly to form a blocking portion 17. The other side of the insulating housing 10 also has the stopping portion 16 extending transversely, and the blocking portion 17 perpendicular to the stopping portion 16. But, the difference is that the blocking portion 17 at the other side of the insulating housing 10 is disposed adjacent to the front surface 11. It also should be noted that the blocking portions 17 can also be extended from both ends of the stopping portion 16 for meeting different demands and should not be limited.

Figure 4:
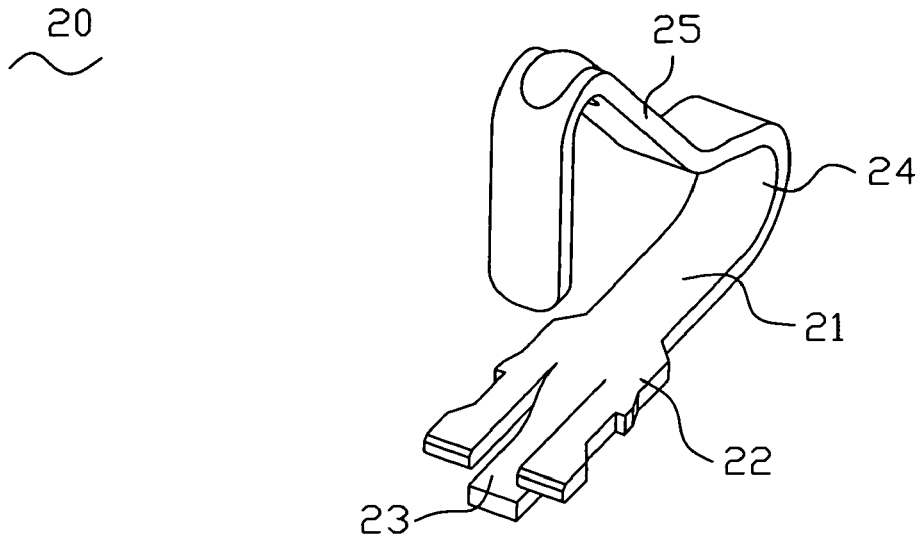
FIG. 4 is a perspective view of a terminal of the electrical connector shown in FIG. 1.
Figure 6:
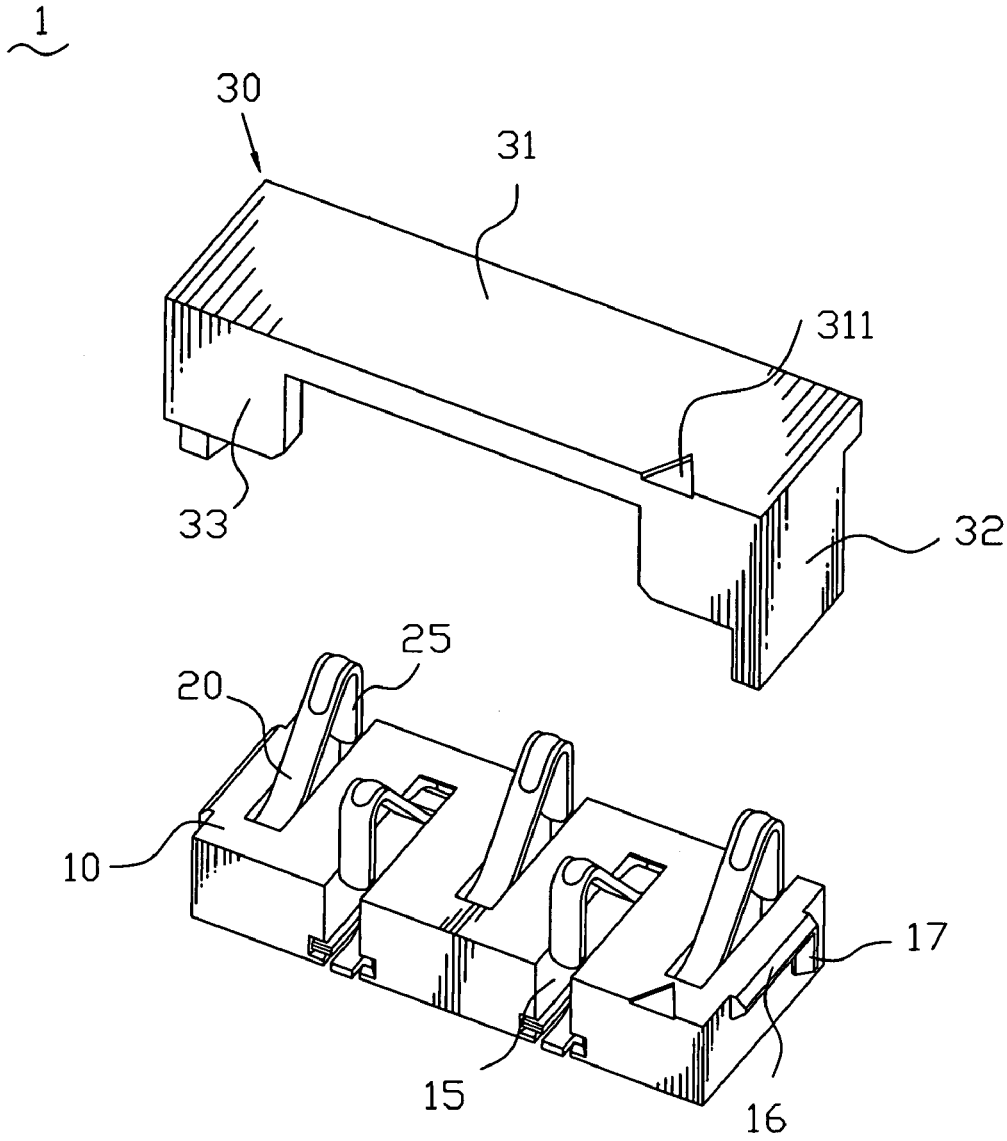
FIG. 6 is an exploded, perspective view of the electrical connector of FIG. 1, wherein the terminals are received in the insulating housing.

Referring to FIG. 1, FIG. 4 and FIG. 6, the terminal 20 received in the groove 15 defines a basic portion 21 of flatboard shape. Two sides of one end of the basic portion 21 extend outwards to form buckling portions 22 accommodated in the corresponding buckling recesses 151. A soldering portion 23 may be punched downwardly from a middle of the end of the basic portion 21. The soldering portion 23 exceeds the bottom surface 14 for being soldered on a printed circuit board (PCB). The other end of the basic portion 21 is bent upwards to form a bending portion 24 overlapping the basic portion 21. The bending portion 24 is substantially arc-shaped. A free end of the bending portion 24 extends obliquely and upwardly, and curves downwardly to form a contacting portion 25. The contacting portion 25 is of substantially inverted-V shape and protruded over the top surface 13. Furthermore, a distal end of the contacting portion 25, disposed substantially vertically with respect to the top surface 13, is substantially flush with the blocking portion 17.

Figure 5:
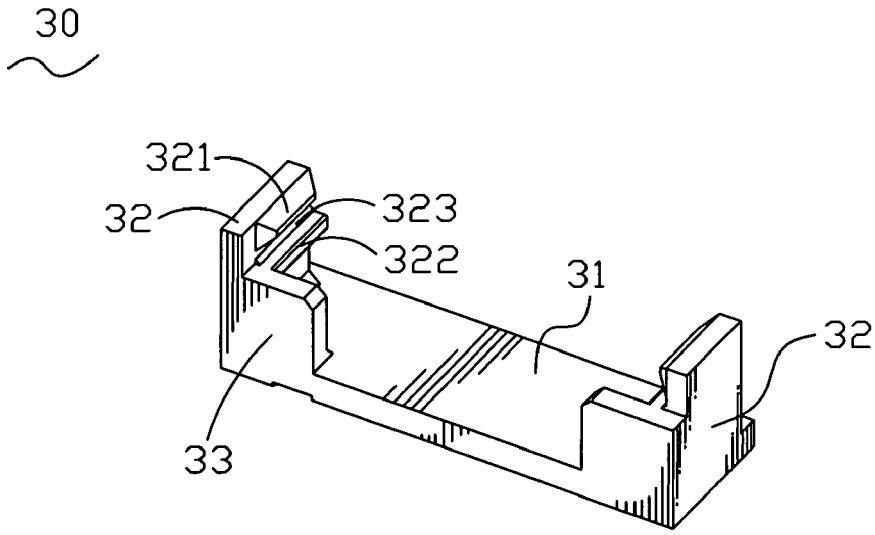
FIG. 5 is a perspective view of a cover of the electrical connector shown in FIG. 1 viewed from a bottom direction.

Please refer to FIG. 1 and FIG. 5, the cover 30 includes a covering plate 31 of oblong shape, two lateral plates 32 extending downwards from two short edges of the covering plate 31 and two anti-mismating portions 33 extending downwardly from a long edge of the covering plate 31. The covering plate 31 has a second directing cavity 311 same as the first directing portion 131 adjacent to the anti-mismating portion 33. The lateral plate 32 has a width substantially equal to the length of the stopping portion 16. An inner surface of the lateral plate 32 defines a first protrusion 321 extending transversely and a second protrusion 322 disposed upon and parallel to the first protrusion 321. The first protrusion 321 and the second protrusion 322 form a receiving recess 323 therebetween for receiving the stopping portion 16. The anti-mismating portions 33 are substantially rectangular and extend downwardly from two ends of the long edge of the covering plate 31, and a middle portion of the long edge of the covering plate 31 between the anti-mismating portions 33 is left for avoiding interfering with contacting portions 25 of the terminals 20. A bottom of the anti-mismating portion 33 is substantially flush with a bottom surface of the second protrusion 322 for making the anti-mismating portion 33 be against the top surface 13 of the insulating housing 10 just right.

Figure 7:
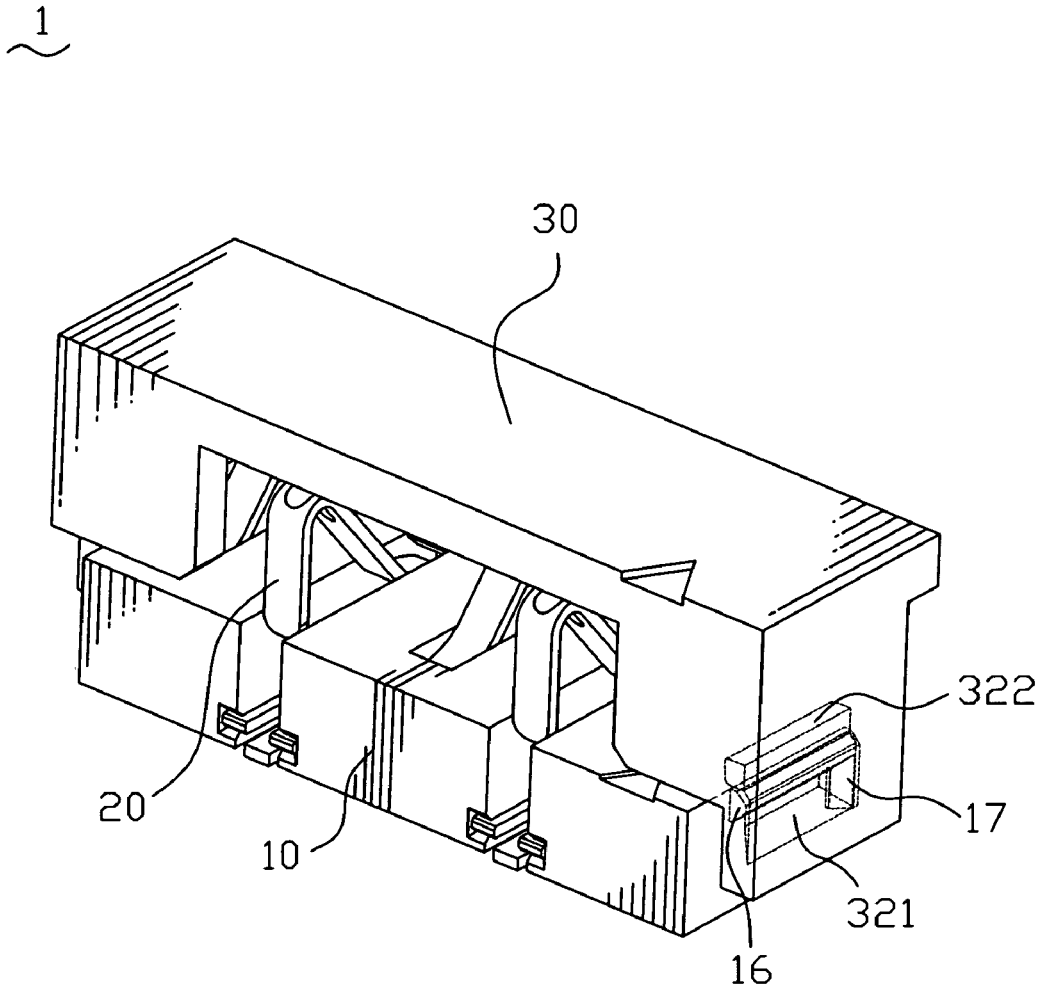
FIG. 7 is a plan view illustrating a structure of the cover engaged with the insulating housing of the electrical connector of FIG. 6 shown in dotted line.

Please refer to FIGS. 5-7, in assembly, the terminals 20 are received in the corresponding grooves 15, the cover 30 is pressed downwardly to be coupled with the insulating housing 10 under guidance of the first and second directing cavity 131 and 311. The stopping portions 16 are respectively restrained between the first protrusion 321 and the second protrusion 322 for preventing the cover 30 from moving upwards and downwards. The blocking portions 17 are against the corresponding ends of the first protrusions 321 for preventing the cover 30 from moving frontward and rearward. The anti-mismating portions 33 are against the top surface 13 of the insulating housing 10 and substantially parallel to the contacting portion 25. When the cover 30 is mounted to the insulating housing 10 in a contrary way, the anti-mismating portions 33 will interfere with the contacting portions 25 of the terminals 20 so that it is impossible to engage the cover 30 with the insulating housing 10.

As described above, the first directing cavity 131 and the second directing cavity 311 are adapted for guiding the cover 30 to be coupled with the insulating housing 10 rightly. When the cover 30 is assembled to the insulating housing 10 reversely, the anti-mismating portion 33 interferes with the contacting portion 25 of the terminal 20 so that the cover 30 cannot be engaged with the insulating housing 10, which is more reliable to avoid the cover 30 from coupling with the insulating housing 10 in an incorrect way.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

an insulating housing defining a top surface, a front surface and a rear surface opposite to the front surface;

a plurality of terminals mounted in the insulating housing, each of the terminals having a contacting portion exceeding the top surface of the insulating housing, at least one of the contacting portions of the terminals being adjacent to the rear surface; and a cover coupled with the insulating housing, the cover having a covering plate suspended over the top surface of the insulating housing, at least one anti-mismating portion corresponding to the terminal of which the contacting portion is adjacent to the rear surface, extending downwardly from the covering plate for being mounted on a portion of the top surface adjacent to the front surface, the anti-mismating portion being capable of interfering with the contacting portion of the terminal when the cover is mounted to the insulating housing in a contrary way, the cover including two lateral plates, an inner surface of each of the lateral plates having a first protrusion extending frontward and rearward, and a second protrusion parallel to the first protrusion to form a receiving recess, a side of the insulating housing corresponding to the lateral plate having a stopping portion extending frontward and rearward received in the receiving recess for preventing the cover from moving upwards and downwards;

wherein the stopping portion has at least one end extending substantially perpendicular to the stopping portion to form a blocking portion.

2. The electrical connector as claimed in claim 1, wherein the blocking portion is against an end of the first protrusion for restraining the cover from moving frontward and rearward.

3. The electrical connector as claimed in claim 2, wherein an upper surface of the stopping portion is substantially flush with the top surface of the insulating housing, the anti-mismating portion extends downwardly from an edge of the covering plate, a bottom of which is substantially flush with a bottom surface of the second protrusion disposed upon the first protrusion for making the anti-mismating portion be against the top surface of the insulating housing just right.

4. The electrical connector as claimed in claim 1, wherein the top surface of the insulating housing has a first directing cavity, the first directing cavity is triangle shape, with an angle pointing at the rear surface, the covering plate has a second directing cavity same as the first directing cavity for guiding correct assembly.

5. The electrical connector as claimed in claim 1, wherein the contacting portion is of substantially inverted-V shape with respect to the top surface of the insulating housing.

6. An electrical connector, comprising:

an insulating housing defining a top surface, a front surface and a rear surface opposite to the front surface, a plurality of spaced longitudinal open grooves formed in the top surface of the insulating housing, of which open ends are respectively and alternately formed at the front surface and the rear surface;

a plurality of terminals mounted in the grooves of the insulating housing, each of the terminals having a contacting portion projecting outside the top surface of the insulating housing, the contacting portions being respectively adjacent to the open ends of the corresponding grooves to be away from opposite closed ends of the corresponding grooves; and a cover coupled with the insulating housing, the cover having a covering plate suspended over the top surface of the insulating housing, at least one anti-mismating portion corresponding to one of the terminals extending downwardly from an end of the covering plate for being mounted on a portion of the top surface facing the closed end of the corresponding groove where the one terminal is disposed and capable of interfering with the contacting portion of the terminal when the cover is mounted to the insulating housing in a contrary way;

wherein the cover further includes two lateral plates, an inner surface of each of the lateral plates has a first protrusion extending frontward and rearward, and a second protrusion parallel to the first protrusion to form a receiving recess, a side of the insulating housing corresponding to the lateral plate has a stopping portion extending frontward and rearward received in the receiving recess for preventing the cover from moving upwards and downwards;

wherein the stopping portion has at least one end extending substantially perpendicular to the stopping portion to form a blocking portion.

7. The electrical connector as claimed in claim 6, wherein the blocking portion is against an end of the first protrusion for restraining the cover from moving frontward and rearward.

8. The electrical connector as claimed in claim 7, wherein an upper surface of the stopping portion is substantially flush with the top surface of the insulating housing, a bottom of the anti-mismating portion is substantially flush with a bottom surface of the second protrusion disposed upon the first protrusion for making the anti-mismating portion be against the top surface of the insulating housing just right.

9. The electrical connector as claimed in claim 6, wherein the top surface of the insulating housing has a first directing cavity, the first directing cavity is triangle shape, with an angle pointing at the rear surface, the covering plate has a second directing cavity same as the first directing cavity for guiding correct assembly.

10. The electrical connector as claimed in claim 6, wherein the contacting portion is of substantially inverted-V shape with respect to the top surface of the insulating housing.

* * * * *